United States Patent [19]

Kurosaki

[11] 4,126,075

[45] Nov. 21, 1978

[54] SUPPORTING DEVICE FOR DRUMS AND LIKE MUSICAL INSTRUMENTS ON A STAND

[75] Inventor: Makoto Kurosaki, Hamamatsu, Japan

[73] Assignee: Nippon Gakki Seizo Kabushiki Kaisha, Japan

[21] Appl. No.: 756,854

[22] Filed: Jan. 5, 1977

[30] Foreign Application Priority Data

Jan. 12, 1976 [JP] Japan ..... 51/1864

[51] Int. Cl.[2] ..... G10G 5/00

[52] U.S. Cl. ..... 84/421

[58] Field of Search ..... 84/411, 421

[56] References Cited

U.S. PATENT DOCUMENTS 2,844,064 7/1958 Bendett ..... 84/421

3,561,716 2/1971 Thompson ..... 84/421 X 3,780,613 12/1973 Ludwig ..... 84/421

*Primary Examiner*—Lawrence R. Franklin

*Attorney, Agent, or Firm*—Ostrolenk, Faber, Gerb & Soffen

[57] ABSTRACT

Supporting device for musical instruments, such as drums and the like, at required postures and positions is provided with upper and lower mounting assemblies each holding the musical instruments via an elastic insert, thereby not only avoiding development of noises on the stand caused by vibrations due to the beating of the musical instruments, but also affording neat holding of the musical instruments at required mounting dispositions without the need for replacement of costly mechanical parts and assuring stable support of the musical instruments even during violent percussive action.

75 Claims, 19 Drawing Figures

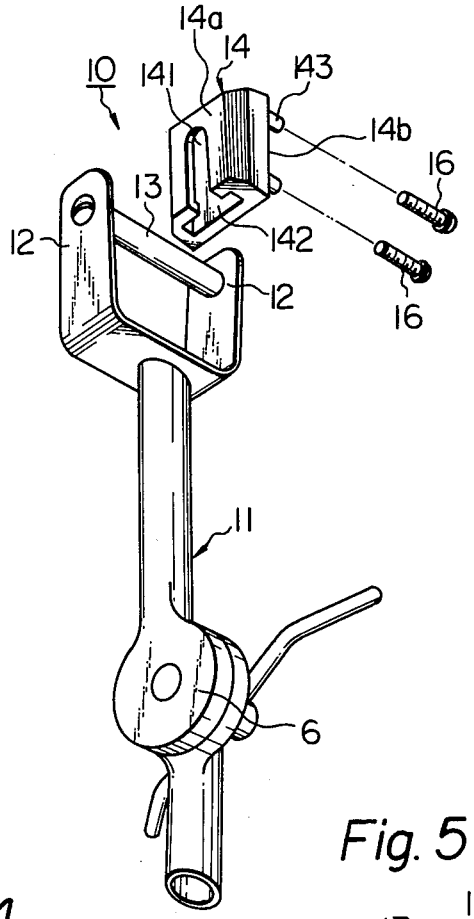
Fig. 3
Fig. 4
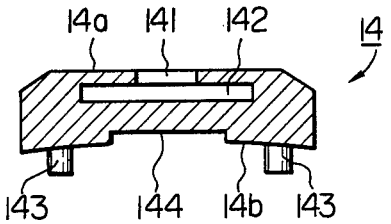
Fig. 5
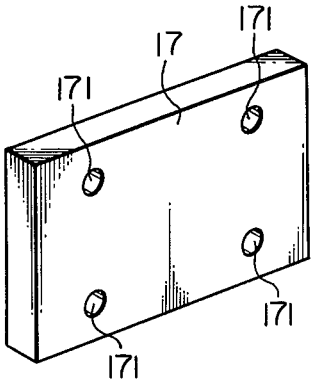

SUPPORTING DEVICE FOR DRUMS AND LIKE MUSICAL INSTRUMENTS ON A STAND

BACKGROUND OF THE INVENTION

The present invention relates to a supporting device for drums and like musical instruments on a stand, and more particularly relates to improvement in the construction of a device for supporting percussion type musical instruments, such as drums and tom-toms, at required postures and positions on a stand placed on the floor.

For concert of percussion musical instruments such as drums, tom-toms and cymbols, a number of percussion instruments of different diameters are arranged around the player in such a manner that the striking surfaces of the instruments are set to confront the player by way of suitable tilter devices disposed upon their associated stands. In general a stand carries a pair of different percussion musical instrument either in a parallel mounting disposition or in an inclined mounting disposition. In some cases, one of the instruments is carried in a parallel mounting disposition and the other in the inclined mounting disposition. Further, the angles of inclination in the inclined mounting disposition vary from instrument to instrument.

The conventional attachment is made of a costly material such as metal and, in general, is provided with a relatively complicated construction in order to be detachably but reliably coupled to the stand. As already described, the mounting disposition of the instruments to the stand varies from instrument to instrument. So, when the mounting disposition changes, the attachment should be changed also so that its confronting surface should have an inclination suited for the new mounting disposition. This means it is necessary with the conventional construction of the attachment to prepare a number of attachments having different inclinations on their confronting surfaces so that musical instruments can be carried by the stand at various mounting dispositions. This burdens percussion instruments players with increased expense on preparation of a number of spare attachments.

Further, the percussion musical instruments are coupled to their associated stand via attachments made of a non-elastic material such as metal. Therefore, in cases when the instruments are vigorously beaten during percussion play, vibrations of the instruments are directly transmitted to the stand via the attachment, thereby causing the stand to generate undesirable noises during the play. This leads to serious degrading of the acoustic quality of the musical instruments.

OBJECTS AND SUMMARY OF THE INVENTION

It is therefore a principal object of the present invention to provide a supporting device for drum-like musical instruments capable of easily and yet securely mounting various types of percussion instruments at required mounting dispositions and inclinations.

It is another object of the present invention to provide a supporting device for percussion musical instruments such as drums which successfully avoids undesirable generation of noises by the stand which supports the instruments, even during exceptionally vigorous percussive play.

In accordance with one aspect of the present invention, an upper assembly for mounting the instruments to a stand includes an elastic element to be inserted between an attachment and an instrument, which elastic element is provided with a pair of mating surfaces, one mating the confronting surface of the attachment and the other the outer peripheral surface of the instrument.

For stable mounting of the musical instruments to the stand, a lower mounting assembly is employed in addition to the above-described upper mounting assembly.

In accordance with another aspect of the present invention, the lower mounting assembly includes an elastic element which snugly engages the outer peripheral surface of the instrument when the assembly is registered at the operative position on the stand.

BRIEF EXPLANATION OF THE DRAWINGS

FIG. 3 is a perspective elevational view of the upper mounting assembly of the present invention in a disassembled and exploded state, FIG. 4 is a transverse cross sectional view of the slide attachment used in the assembly of FIG. 3, FIG. 5 is a perspective elevational view of one embodiment of the elastic insert used for the assembly shown in FIG. 3.

DETAILED DESCRIPTION OF THE INVENTION

Drum-like percussion musical instruments are mounted to their associated stand in various dispositions and inclinations. Two typical examples of such dispositions and inclinations are shown in FIG. 1 and 2.

Figure 1:
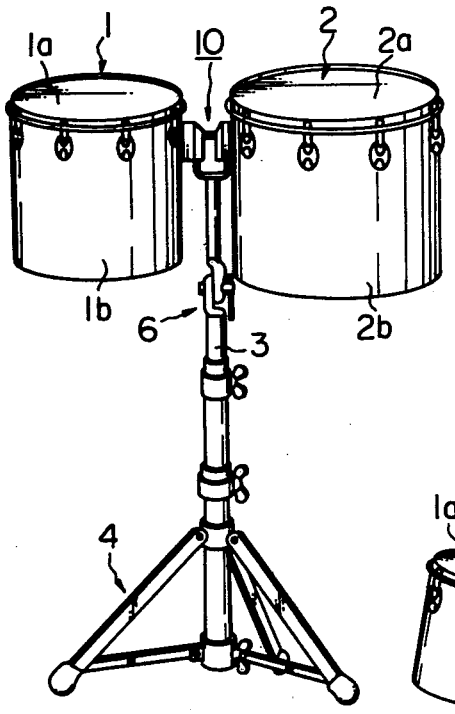
FIG. 1 is a perspective view of drums carried by a stand in a parallel disposition.

In the disposition shown in FIG. 1, two drums 1 and 2 are mounted to a stand 3, which is supported substantially upright on the floor by adjustable legs 4, via an upper mounting assembly 10 and an adjustable tilter device 6, the latter connecting the upper mounting assembly atop the stand 3. In the illustrated disposition, the axial directions of the drums 1 and 2, i.e. the directions substantially perpendicular to their drum heads 1*a* and 2*a*, are almost parallel to the axial direction of the stand 3. In other words, the axial directions of the drums 1 and 2 are vertical. This disposition of the drums 1 and 2 will hereinafter be referred to as "the parallel mounting" of the drums in this specification.

Figure 2:
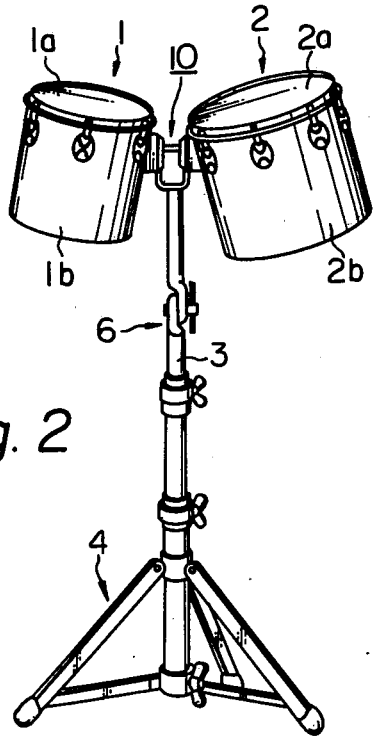
FIG. 2 is a perspective view of the drums carried by a stand in the inclined disposition.

In the disposition shown in FIG. 2, the drums 1 and 2 are mounted to the stand 3 in such an arrangement that the axial directions of the drums 1 and 2 are inclined with respect to the axial direction of the stand 3. In other words, the axial directions of the drums 1 and 2 are oblique to the vertical direction. This disposition will hereinafter be referred to as "the inclined mounting" of the drums in this specification.

As a variant of the illustrated dispositions, one of the drums may be mounted to the stand 3 in "the parallel mounting" whereas the other may be mounted in "the inclined mounting".

A typical construction of an upper mounting assembly 10, to which one aspect of the present invention is to be applied, is shown in a disassembled state in FIG. 3. The mounting assembly 10 comprises a standard 11 extending downwardly and being coupled to the stand 3 via the tilter device 6 and provided at its upper end with a pair of branched tongue plates 12. A tongue bar 13 spans between the pair of tongue plates 12 in a direction almost at a right angle to the axial direction of the standard 11. Two sets of slide attachments 14 are to be used in combination with the tongue bar 13 and their associated tongue plates 12, only one of such slide attachments being shown in the drawing.

The slide attachment 14 is provided with a vertical slot 141 formed in one side surface 14*a* thereof and adapted for slidable engagement with the tongue bar 13 in the assembled state of the upper mounting assembly 10. Vertical slot 141 inwardly merges into a vertical recess 142 of increased width and is adapted for slidable engagement with the associated tongue plate 12 in the assembled state of the upper mounting assembly 10. The vertical slot 141 and the vertical recess 142 both open only at the bottom of the slide attachment 14. The slide attachment 14 is further provided with a plurality of projections 143 formed on the other side surface 14*b* thereof and adapted for threaded engagement with associated fastening screws 16 as hereinafter described.

When the drums are mounted to the stand via the upper mounting assembly as later described in more detail, the above-described one side surface 14*a* of the slide attachment 14, in which the vertical slot 141 is formed, faces away from the drum body whereas the above-described opposite side surface 14*b* of the slide attachment 14 confronts the outer surface of the drum body portion 1*b* or 2*b*. For these reasons, the one side surface 14*a* shall hereinafter be referred to as "the exposed surface" and the other surface 14*b* as "the confronting surface" in this specification.

One embodiment of the upper mounting assembly 10 in accordance with one aspect of the present invention is shown in FIGS. 4 and 5, in which the slide attachment 10 is provided with a concave confronting surface 14*b* in which a center vertical groove 144 is formed as shown in FIG. 4. The mounting assembly 10 further comprises an insert 17 shaped in the form of a flat plate and made of an elastic material such as rubber, as shown in FIG. 5. The elastic insert 17 is provided with through holes 171 adapted for receiving the associated projections 143 of the slide attachment 14.

Figure 6:
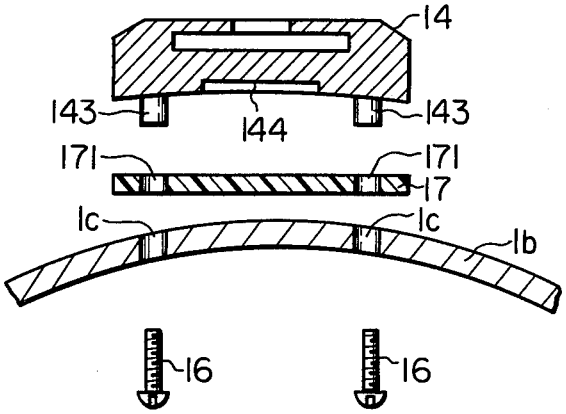
FIG. 6 is a plan view, partly in section, for showing how to assemble the assembly using the elastic insert shown in FIG. 5, FIGS. 7A and 7B are plan views, partly in section, for showing different assembled states of the assembly using the elastic insert shown in FIG. 5.

With the mounting assembly 10 of the above-described construction, mounting of the drums 1 and 2 to the stand 3 is carried out in a manner shown in FIG. 6. That is, the elastic insert 17 is aligned with the slide attachment 14 so that the projections 143 of the latter enter into the corresponding through holes 171 of the former, the combined slide attachment 14 and the elastic insert 17 are aligned with the drum body portion 1*b* so that the projections 143 enter into corresponding through holes 1*c* of the drum body portion 1*b* and the fastening screws 16 are screwed into the corresponding projections 143 of the slide attachment 14 from the interior of the drum body portion 1*b*, thereby the slide attachment 14, the elastic insert 17 and the drum 1 are integrally joined to one another. Next, the slide attachment 14 is coupled to the stand 3 with the tongue plate 12 being received in the vertical recess 142 and the tongue bar 13 being received in the vertical slot 141 (see FIG. 3). It will be well understood that this embodiment of the upper mounting assembly 10 is preferably used for "the parallel mounting" of the drums shown in FIG. 1.

Figure 7A:
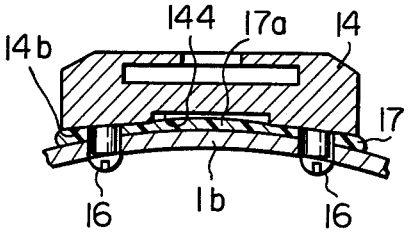

FIG. 7A shows the slide attachment 14, the elastic insert 17 and the drum in the fully assembled state wherein the radius of curvature of the drum body portion 1*b* is relatively small. As the screws 16 are fastened, the surface of the elastic insert 17 mating with the drum body portion 1*b* is brought into intimate pressure contact with the outer surface of the latter and follows the curvature thereof. The surface of the elastic insert 17 mating with the slide attachment 14 is also brought into pressure contact with the confronting surface 14*b* of the attachment 14 and, due to this deformation, the center portion 17*a* of the elastic insert 17 bulges into the vertical groove 144 of the slide attachment 14. In other words, deformation of the elastic insert 17 caused by the tightening of screws 16 is absorbed by the vertical groove 144 of the slide attachment 14. Thus, the slide attachment 14 can fairly be placed into snug engagement with the drum which is to be mounted to the stand 3 via the mounting assembly 10.

Figure 7B:
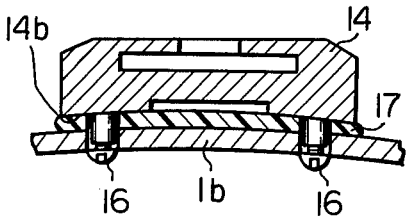

FIG. 7B shows another assembly of the slide attachment 14, the elastic insert 17 and the drum wherein the radius of curvature of the drum body portion 1*b* is relatively large. Similar to the assembly shown in FIG. 7A, as the screws are fastened, the surface of the elastic insert 17 mating with the drum body portion 1*b* is brought into pressure contact with the outer surface of the latter and follows the curvature thereof whereas the surface of the elastic insert 17 mating with the slide attachment 14 is also brought into pressure contact with the confronting surface 14*b* of the attachment 14. However, in this case, the extent of deformation of the elastic insert 17 is smaller than that in the assembled state shown in FIG. 7A because the radius of curvature of the drum is larger than that of the drum shown in FIG. 7A. Thus, in the assembly shown in FIG. 7B, deformation of the elastic insert 17 by screw fastening develops substantially no center bulge, although the slide attachment 14 can fairly be placed into snug engagement with the drum.

It will be well understood that the upper mounting assembly 10 in accordance with one aspect of the present invention is usable for mounting of drums of different diameters to the stand 3 without need for replacement of any mechanical element.

Further, the elastic element, i.e. the elastic insert 17, effectively absorbs vibrations generated by beating of the drums and transmitted to the stand 3 from the drums via the mounting assembly 10. Thus, provision of the elastic element in the construction of the mounting assembly 10 in accordance with one aspect of the present invention effectively prevents undesirable generation of noises in the stand which is otherwise caused by vibration of the drums when the same are beaten.

Figure 8:
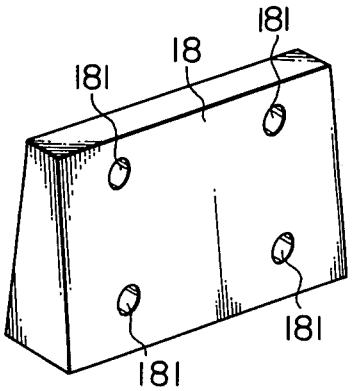
FIG. 8 is a perspective elevational view of another embodiment of the elastic insert.

Another embodiment of the elastic insert usable for the mounting element in accordance with the one aspect of the present invention is shown in FIG. 8, in which the thickness of the elastic insert 18 gradually increases from top to bottom. Just like the insert 17 shown in FIG. 5, the elastic insert 18 of this embodiment is also provided with through holes 181 adapted for receiving the projections 143 of the slide attachment 14 (see FIG. 4). This elastic insert 18 of the modified shape is preferably used in combination with the slide attachment 14 such as the one shown in FIG. 4.

Figure 9:
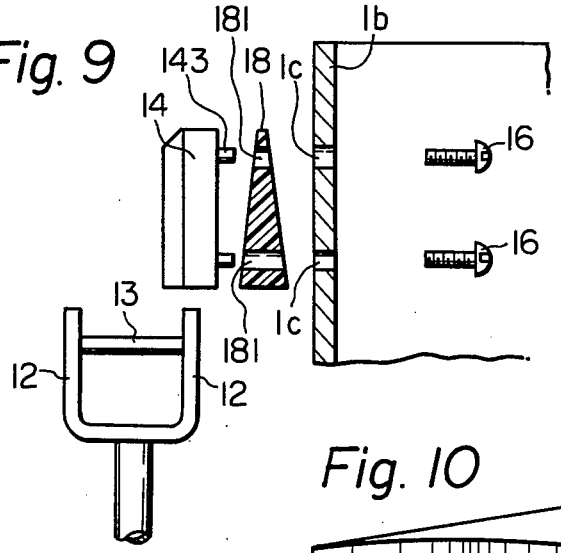
FIG. 9 is a side view, partly in section, for showing how to assemble the assembly using the elastic insert shown in FIG. 8.

Now referring to FIG. 9, the slide attachment 14, the elastic insert 18 and the drum are combined to each other in a manner substantially similar to that shown in FIG. 6. That is, the elastic insert 18 is aligned with the slide attachment 14 so that projections 143 of the latter enter into the corresponding through holes 181 of the former, the combined slide attachment 14 and the elastic insert 18 are aligned with the drum body portion 1*b* so that projections 143 enter into corresponding through holes 1*c* of the drum body portion 1*b* and the fastening screws 16 are then screwed into the corresponding projections 143 of the slide attachment 14 from the interior of the slide attachment 14 and the interior of the drum body portion 1*b*, whereby the slide attachment 14, the elastic insert 17 and the drum 1 are integrally joined to one another. It will be well understood that the upper mounting assembly 10 employing this elastic insert 18 is preferably used for "the inclined mounting" of the drums such as shown in FIG. 2.

For inclined mountings of drums of different angles of inclination, elastic inserts of different trapezoidal transverse cross sectional profiles can be used, thereby successfully avoiding need for replacement of the slide attachment. In other words, in accordance with the present invention, a common slide attachment is usable for mountings of drums at various angles of inclination. Only replacement of the elastic insert 18 is required for different mountings, which can be manufactured far easier and at lower cost than the slide attachment.

Figure 10:
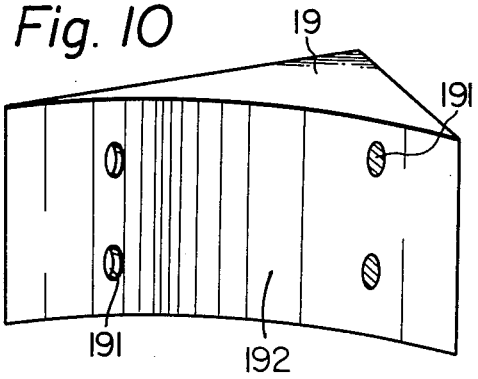
FIG. 10 is a perspective elevational view of another embodiment of the elastic insert.

A further modified embodiment of the elastic insert usable in combination with the slide attachment 14 is shown in FIG. 10, in which the elastic insert 19 is provided with through holes 191 adapted for receiving the projections 143 of the attachment. In this instance, the thickness of the insert is gradually increased from left to right. The surface 192 of the insert 19 mating the drum body may have a slight concave shape so as to facilitate a snug fitting of the two.

Figure 11:
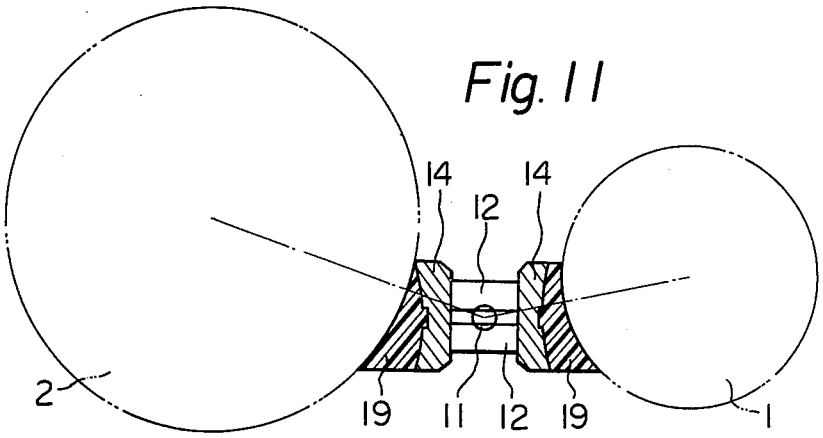
FIG. 11 is a plan view, partly in section, for showing how to mount the drums to the stand using the elastic insert shown in FIG. 10, FIGS. 12 and 13 are perspective elevational views of one embodiment of the lower mounting assembly of the present invention.

By using inserts 19 of different thickness distribution and surface curvature, the center angle between radial lines connecting the center axis of the standard 11 to the center axes of the drums 1 and 2 (see FIG. 11) can be adjusted as desired.

Figure 12:
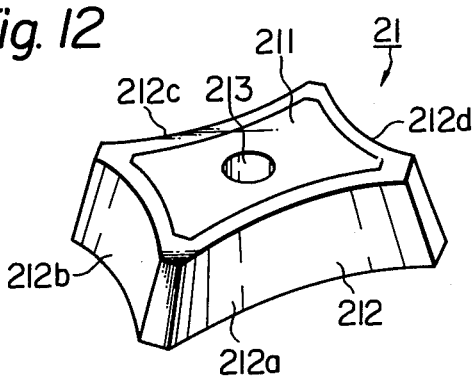
Figure 13:
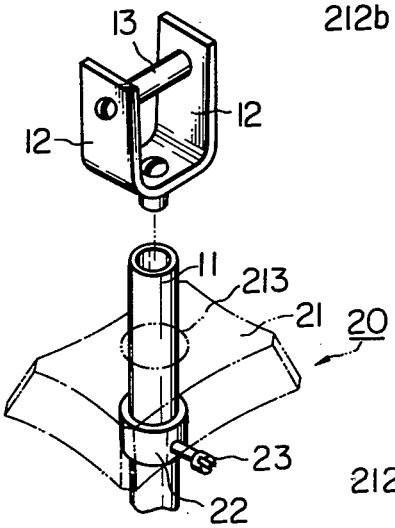

A typical construction of the lower mounting assembly 20, to which the other aspect of the present invention is to be applied, is shown in FIGS. 12 and 13. The lower mounting assembly 20 comprises a holder block 21 of a substantially flattened rectangular solid shape and comprised of a core piece 211 and an elastic covering 212 covering the four side surfaces of the core piece 211. A vertical through hole 213 is formed in the core piece 21 so as to enable the holder block 21 to be inserted over the standard 11 as shown with chain-and-dot lines in FIG. 13. The four side surfaces 212*a* to 212*d* of the holder block 21 have a concave shape so as to fit the curvatures of the drums to be held by the holder block 21 as hereinafter described in detail.

Figure 14A:
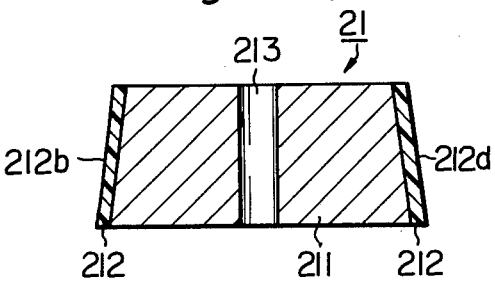
FIGS. 14A through 15B are side views, partly in section, of various embodiments of the holder block used for the lower mounting block.
Figure 14B:
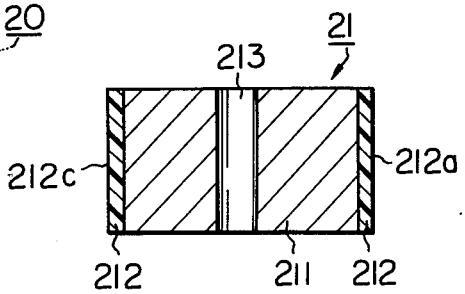

In the case of the embodiment of the holder block 21 shown in FIGS. 14A and 14B, one pair of opposite side surfaces 212*b* and 212*d* are inclined to the axial direction of the holder block 21, i.e. the axial direction of the vertical through hole 213 whereas the other pair of opposite surfaces 212*a* and 212*c* are parallel to the above-described axial direction of the holder block 21.

Figure 15A:
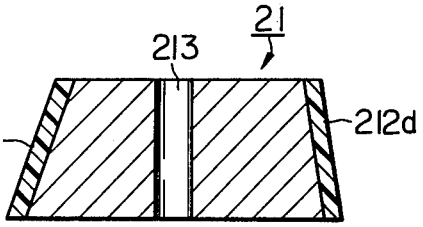
Figure 15B:
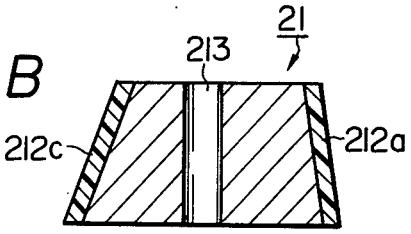

In the case of embodiment of the holder block 21 shown in FIGS. 15A and 15B, the four side surfaces 212*a* to 212*d* are all inclined to the axial direction of the holder block 21 but at different angles of inclination.

The elastic covering 21 is made of an elastic material such as rubber, resin or felt.

Referring to FIG. 13, the lower mounting assembly 20 further comprises a collar 22 slidably insertable over the standard 11 and a set screw 23 is provided for fixing the collar 22 at any desired position along the standard 11. The construction comprised of the tongue plates 12 and the tongue bar 13 is preferably detachably coupled atop the standard 11 for easy replacement of the holder block 21.

Figure 16:
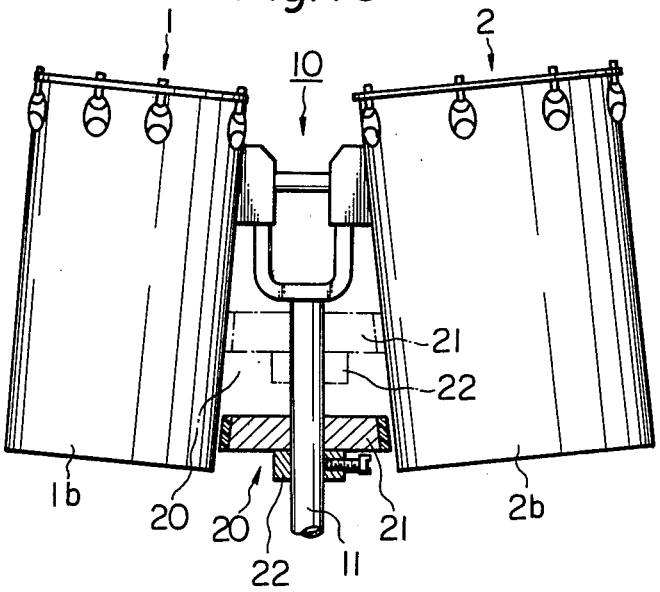
FIG. 16 is a side view, partly in section, for showing how to mount the drums to the stand using the lower mounting assembly.

Using the lower mounting assembly 20 of the above-described construction, the drums 1 and 2 are mounted to the stand 3 in a manner shown in FIG. 16.

Prior to mounting, the collar 22 and the holder block 21 are inserted over the standard 11, and the upper mounting assembly 10 and the drums 1 and 2 are assembled with each other. After the postures of the drums 1 and 12 are fixed by the upper mounting assembly 10, the holder block 21 and the collar 22 are slid upwardly along the standard 11 until the side surface thereof in the operative position comes into snug contact with the outer surfaces of the associated drum body portions 1*b* and 2*b*. When the holder block 21 is registered at the correct position, the set screw 23 is fastened in order that the collar 22 should uphold the holder block 21 at the desired position as shown with chain-and-dot lines in FIG. 16.

It will be well understood that, when the side surfaces 212*b* and 212*d* of the holder block 21 shown in FIG. 14A are set in the operative position, the drums 1 and 2 both assume an inclined mounting disposition at equal angle of inclination. When the side surfaces 212*a* and 212*c* of the holder block 21 shown in FIG. 14B are set in the operative position, the drums 1 and 2 both assume the parallel mounting disposition. Further, when any one pair of the side surfaces shown in FIGS. 15A and 15B, e.g. the side surfaces 212*a* and 212*c* shown in FIG. 15B, are set in the operative position, the drums 1 and 2 assume inclined mounting dispositions at different angles of inclination.

In accordance with the present invention, a common single lower mounting assembly can assure a variety of mounting dispositions of the drums to the stand without any need for replacement of the mechanical elements when the mounting is changed.

In the construction of the supporting device of the present invention, the upper and lower mounting assemblies may be used either in combination with each other or separately from each other. For example, the lower mounting assembly in accordance with the present invention may be used in combination with either the upper mounting assembly in accordance with the present invention or any conventional upper mounting assembly.

I claim:

1. A supporting device for drums and like musical instruments comprising an upper mounting assembly, a lower mounting assembly and a standard, said upper mounting assembly including an attachment fixable to said standard, an elastic element to be inserted between said attachment and any one of said musical instruments, and means for coupling said one musical instrument to said attachment with said elastic element disposed therebetween, said lower mounting assembly including a holder block slidable along said standard, and means for fixing said holder block at any selected position along said standard.

2. The supporting device as claimed in claim 1 in which the said coupling means includes projections formed on the surface of said attachment mating said elastic insert and fastening screws adapted for threadedly screw engaging said projections which extend through said elastic element and a body portion of said musical instrument.

3. The supporting device as claimed in claim 2 in which said elastic element is a flat plate-shaped elastic insert provided with through holes adapted for receiving the projections of said attachment.

4. The supporting device as claimed in claim 2 in which said elastic element is an elastic insert of a trapezoidal transverse cross sectional profile diverging toward the bottom and provided with through holes adapted for receiving the projections of said attachment.

5. The supporting device as claimed in claim 2 in which said elastic element is an elastic insert provided with a concave surface on the side adapted to engage the body portion of said musical instrument and having through holes adapted for receiving the projections of said attachment.

6. The supporting device as claimed in claim 1 in which said holder block of said lower mounting assembly includes at least a pair of opposite elastic surfaces adapted for making snug surface contact with a body portion of said musical instrument.

7. The supporting device as claimed in claim 6 in which said opposite elastic surfaces extend parallel to the axial direction of said standard.

8. The supporting devices as claimed in claim 6 in which said opposite elastic surfaces are inclined to the axial direction of said standard.

9. The supporting device as claimed in claim 8 in which the angles of inclination of said elastic surfaces are equal to each other.

10. The supporting device as claimed in claim 8 in which the angles of inclination of said elastic surfaces are different from each other.

11. The supporting device as claimed in claim 6 in which said holder block comprises a core piece and an elastic covering which covers side surfaces of said core piece.

12. The supporting device as claimed in claim 11, in which said elastic covering is made of rubber.

13. The supporting device as claimed in claim 11, in which said elastic covering is made of resin.

14. The supporting device as claimed in claim 11, in which said elastic covering is made of felt.

15. The supporting device as claimed in claim 1 in which said fixing means of said lower mounting assembly comprises a collar slidably receiving said standard and having an adjustable set screw for fixing said collar to said standard.

16. The supporting device as claimed in claim 1, wherein said elastic element is a flat plate-shaped elastic insert.

17. The supporting device as claimed in claim 1, wherein said elastic element is an elastic insert of a trapezoidal transverse cross-sectional profile diverging towards the bottom.

18. The supporting device as claimed in claim 1, wherein said elastic element is an elastic insert provided with a concave surface on the side adapted to engage the body portion of said musical instrument.

19. The supporting device as claimed in claim 1, wherein said attachment has a concave confronting surface on the side adapted to engage said elastic element.

20. The supporting device as claimed in claim 19, wherein said concave confronting surface is provided with a groove formed therein.

21. The supporting device as claimed in claim 1, wherein at least a portion of said standard extends along a predetermined axis and wherein said holder block includes at least a pair of opposite surfaces extending parallel to said axis.

22. The supporting device as claimed in claim 1, wherein at least a portion of said standard extends along a predetermined axis and wherein said holder block includes at least a pair of opposite surfaces inclined with respect to said axis.

23. The supporting device as claimed in claim 22, in which the angles of inclination of said opposite surfaces are substantially equal to each other.

24. The supporting device as claimed in claim 22, in which the angles of inclination of said opposite surfaces are different from each other.

25. The supporting device as claimed in claim 1, in which said holder block comprises a core piece and a covering which covers side surfaces of said core piece.

26. The supporting device as claimed in claim 1, wherein at least a portion of said standard extends along a predetermined axis and wherein said holder block includes first and second pairs of opposite surfaces, said first pair of opposite surfaces forming a first angle with said axis, said second pair of opposite surfaces forming a second angle with said axis.

27. The supporting device as claimed in claim 26, wherein said first and second angles are different.

28. The supporting device as claimed in claim 1, wherein at least a portion of said standard extends along a predetermined axis and wherein said elastic element has a shape which will cause said musical instruments to be off-center with respect to said axis when said musical instruments are coupled to said attachment.

29. A supporting device for drums and like musical instruments comprising an upper mounting assembly, a lower mounting assembly, and a standard, said upper mounting assembly including an attachment fixable to said standard, an elastic element to be inserted between said attachment and any one of said musical instruments and means for coupling said one musical instrument to said attachment with said elastic element disposed therebetween, said lower mounting assembly supporting said one musical instrument at the side thereof.

30. The supporting device as claimed in claim 29 in which said coupling means includes projections formed on the surface of said attachment extending through said elastic insert and fastening screws adapted to threadedly engage said projections extending through said elastic element and thereby resiliently join the body portion of said musical instrument to the standard.

31. The supporting device as claimed in claim 30 in which said elastic element is a flat plate-shaped elastic insert provided with through holes adapted for receiving the projections of said attachment.

32. The supporting device as claimed in claim 30 in which said elastic element is an elastic insert of a trapezoidal transverse cross sectional profile diverging toward the bottom and provided with through holes adapted for receiving said projections of said slide attachment.

33. The supporting device as claimed in claim 30 in which said elastic element is an elastic insert provided with a concave surface on the side to mate with said body portion of said musical instrument and through holes adapted for receiving said projections of said slide attachment.

34. The supporting device as claimed in claim 29, wherein said elastic element is a flat plate-shaped elastic insert.

35. The supporting device as claimed in claim 29, wherein said elastic element is an elastic insert of a trapezoidal transverse cross-sectional profile diverging towards the bottom.

36. The supporting device as claimed in claim 29, wherein said elastic element is an elastic insert provided with a concave surface on the side adapted to engage the body portion of said musical instrument.

37. The supporting device as claimed in claim 29, wherein said attachment has a concave confronting surface on the side adapted to engage said elastic element.

38. The supporting device as claimed in claim 37, wherein said concave confronting surface is provided with a groove formed therein.

39. The supporting device as claimed in claim 29, wherein at least a portion of said standard extends along a predetermined axis and wherein said lower mounting comprises a holder block, and said holder block includes at least a pair of opposite surfaces extending parallel to said axis.

40. The supporting device as claimed in claim 29, wherein at least a portion of said standard extends along a predetermined axis and wherein said lower mounting comprises a holder block, and said holder block includes at least a pair of opposite surfaces inclined with respect to said axis.

41. The supporting device as claimed in claim 40, in which the angles of inclination of said opposite surfaces are substantially equal to each other.

42. The supporting device as claimed in claim 40, in which the angles of inclination of said opposite surfaces are different from each other.

43. The supporting device as claimed in claim 29, in which said lower mounting comprises a holder block, and said holder block comprises a core piece and a covering which covers side surfaces of said core piece.

44. The supporting device as claimed in claim 29, wherein at least a portion of said standard extends along a predetermined axis and wherein said lower mounting comprises a holder block, and said holder block includes first and second pairs of opposite surfaces, said first pair of opposite surfaces forming a first angle with said axis, said second pair of opposite surfaces forming a second angle with said axis.

45. The supporting device as claimed in claim 44, wherein said first and second angles are different.

46. The supporting device as claimed in claim 29, wherein at least a portion of said standard extends along a predetermined axis and wherein said elastic element has a shape which will cause said musical instruments to be off-center with respect to said axis when said musical instruments are coupled to said attachment.

47. A supporting device for drums and like musical instruments comprising a standard, an upper mounting assembly connecting any one of said musical instruments to said standard at a required disposition, and a lower mounting assembly, said lower mounting assembly including a holder block slidable along said standard, and means for fixing said holder block at a selected position along said standard, thereby supporting said one musical instrument at the side thereof.

48. The supporting device as claimed in claim 47 in which said holder block of said lower mounting assembly includes at least a pair of opposite elastic surfaces adapted to make snug surface contact with the body portion of said musical instrument.

49. The supporting device as claimed in claim 48 in which said opposite elastic surfaces extend parallel to the axial direction of said standard.

50. The supporting device as claimed in claim 48 in which said opposite elastic surfaces are inclined to the axial direction of said standard.

51. The supporting device as claimed in claim 50 in which the angles of inclination of said elastic surfaces are equal to each other.

52. The supporting device as claimed in claim 50 in which the angles of inclination of said elastic surfaces are different from each other.

53. The supporting device as claimed in claim 48 in which said holder block comprises a core piece and an elastic covering which covers side surfaces of said core piece.

54. The supporting device as claimed in claim 47 in which said fixing means of said lower mounting assembly comprises a collar slidably mounted on said standard of said stand and having a set screw for fixing said collar to said standard.

55. A supporting device for drums and like musical instruments comprising a mounting assembly and a standard, said mounting assembly including an attachment fixable to said standard, an elastic element to be inserted between said attachment and any one of said musical instruments, and means for coupling said one musical instrument to said attachment with said elastic element disposed therebetween.

56. The supporting device as claimed in claim 55 in which said coupling means includes projections formed on the surface of said attachment extending through said elastic insert and fastening screws adapted to threadedly engage the projections extending through said elastic element to join the body portion of said musical instrument to the standard.

57. The supporting device as claimed in claim 56 in which said elastic element is a flat plate-shaped elastic insert provided with through holes adapted for receiving the projections of said attachment.

58. The supporting device as claimed in claim 56 in which said elastic element is an elastic insert of a trapezoidal transverse cross sectional profile diverging toward the bottom and provided with through holes for receiving the projections of said attachment.

59. The supporting device as claimed in claim 56 in which said elastic element is an elastic insert provided with a concave surface on the side which engages the body portion of said musical instrument and through holes for receiving the projections of said attachment.

60. The supporting device as claimed in claim 55, wherein said elastic element is a flat plate-shaped elastic insert.

61. The supporting device as claimed in claim 55, wherein said elastic element is an elastic insert of a trapezoidal transverse cross-sectional profile diverging towards the bottom.

62. The supporting device as claimed in claim 55, wherein said elastic element is an elastic insert provided with a concave surface on the side adapted to engage the body portion of said musical instrument.

63. The supporting device as claimed in claim 55, wherein said attachment has a concave confronting surface on the side adapted to engage said elastic element.

64. The supporting device as claimed in claim 63, wherein said concave confronting surface is provided with a groove formed therein.

65. The supporting device as claimed in claim 55, wherein at least a portion of said standard extends along a predetermined axis and wherein said supporting device further includes a holder block, and said holder block includes at least a pair of opposite surfaces extending parallel to said axis.

66. The supporting device as claimed in claim 55, wherein at least a portion of said standard extends along a predetermined axis and wherein said supporting device further includes a holder block, and said holder block includes at least a pair of opposite surfaces inclined with respect to said axis.

67. The supporting device as claimed in claim 66, in which the angles of inclination of said opposite surfaces are substantially equal to each other.

68. The supporting device as claimed in claim 66, in which the angles of inclination of said opposite surfaces are different from each other.

69. The supporting device as claimed in claim 55, in which said supporting device further includes a holder block, and said holder block comprises a core piece and an elastic covering which covers side surfaces of said core piece.

70. The supporting device as claimed in claim 69, in which said elastic covering is made of rubber.

71. The supporting device as claimed in claim 69, in which said elastic covering is made of resin.

72. The supporting device as claimed in claim 69, in which said elastic covering is made of felt.

73. The supporting device as claimed in claim 55, wherein at least a portion of said standard extends along a predetermined axis and wherein said supporting device further includes a holder block, and said holder block includes first and second pairs of opposite surfaces, said first pair of opposite surfaces forming a first angle with said axis, said second pair of opposite surfaces forming a second angle with said axis.

74. The supporting device as claimed in claim 73, wherein said first and second angles are different.

75. The supporting device as claimed in claim 55, wherein at least a portion of said standard extends along a predetermined axis and wherein said elastic element has a shape which will cause said musical instruments to be off-center with respect to said axis when said musical instruments are coupled to said attachment.

* * * * *